US005989351A

United States Patent [19]

Mizutani et al.

[11] Patent Number: 5,989,351

[45] **Date of Patent: *Nov. 23, 1999**

[54] NONCENTRIFUGAL SUGAR COMPOSITION AND A PROCESS FOR THE PREPARATION OF A SUGAR PRODUCT

[75] Inventors: Takeo Mizutani, Yokohama; Tadashi Ebashi, Nagareyama; Kozo Yamada; Toshiaki Sugitani, both of Kamakura; Masaaki Kodomari, Kawasaki, all of Japan

[73] Assignees: Mitsui Sugar Co., Ltd., Tokyo, Japan; The Kumphawapi Sugar Co. Ltd., Bangkok, Thailand

[ * ] Notice: This patent issued on a continued prosecution application filed under 37 CFR 1.53(d), and is subject to the twenty year patent term provisions of 35 U.S.C. 154(a)(2).

[21] Appl. No.: 08/903,760

[22] Filed: Jul. 31, 1997

[30] Foreign Application Priority Data

| | | | |
|---|---|---|---|
| Jul. 31, 1996 | [JP] | Japan | 8-216929 |
| Jul. 2, 1997 | [JP] | Japan | 9-190724 |

[51] Int. Cl.[6] ..... C13F 1/00; C13F 3/00

[52] U.S. Cl. ..... 127/55; 127/30; 127/61

[58] Field of Search ..... 127/30, 55, 61

[56] References Cited

U.S. PATENT DOCUMENTS

| | | | |
|---|---|---|---|
| 1,740,693 | 12/1929 | Hersey | 127/61 |
| 3,972,725 | 8/1976 | Nicol | 127/58 |
| 4,115,147 | 9/1978 | Shimizu et al. | 127/54 |
| 4,342,603 | 8/1982 | Daniels | 127/61 |
| 4,362,757 | 12/1982 | Chen et al. | 426/599 |
| 4,640,717 | 2/1987 | Sehukla et al. | 127/58 |

FOREIGN PATENT DOCUMENTS

| | | |
|---|---|---|
| 60-30700 | 2/1985 | Japan . |
| 60-133900 | 7/1985 | Japan . |
| 1-16480 | 3/1989 | Japan . |

*Primary Examiner*—David Brunsman
*Attorney, Agent, or Firm*—William H. Dippert; Cowan, Liedowitz & Latman, P.C.

[57] ABSTRACT

The present invention provides a process for the preparation of a noncentrifugal sugar composition. The process comprises the following steps: cane juice is filtered; a pH of the juice is adjusted to 5.0–6.0; sucrose or liquid sucrose or both is added to adjust a purity of the mixture to a range of 87.0 to 95.1% by weight; the mixture is heated and evaporated; and then the mixture is cooled to solidify with a strong shearing force being applied to obtain granules.

17 Claims, 2 Drawing Sheets

NONCENTRIFUGAL SUGAR COMPOSITION AND A PROCESS FOR THE PREPARATION OF A SUGAR PRODUCT

FIELD OF THE INVENTION

The present invention relates to a noncentrifugal sugar composition in which cane juice is used as a starting material.

The present invention relates also to a process for the preparation of a noncentrifugal sugar composition.

The present invention relates further to a process for the preparation of granule-formed sugar, particularly to the process in which a step of drying, cooling and conditioning sugar is simplified.

PRIOR ART

Cane sugar is classified roughly into two groups. One is noncentrifugal sugar (i.e. molasses-containing sugar) which is prepared by solidifying concentrated cane juice as a whole without separating molasses from sugar crystal, and the other is centrifugal sugar (i.e. molasses-removed sugar) which is prepared by centrifuging concentrated cane juice to separate the molasses component from massecuite. In a process for the preparation of the centrifugal sugar which is virtually pure sucrose, various nutritionally valuable minor components which are contained in the cane juice are removed as impurities without being used effectively. They are, for example, reducing sugars such as glucose and fructose, abundant minerals such as calcium, potassium and magnesium, and vitamins which are considered to be effective for keeping health.

As healthy foods-oriented tendency increases recently, the number of consumers recognizing that refined sugars (i.e., white soft sugar, granulated sugar, and so on) are composed of almost pure sucrose and are extremely unbalanced nutrition is increasing. Accordingly, their consumption has decreased year by year. Meanwhile, people tend to prefer brown sugar or brown soft sugar in which flavor and nutritional components remain, or sugars enriched with nutritional components and minerals. The brown sugar lump (Japan) or O-tung (China) is generally prepared by adding milk lime to the cane juice to alkalinize, followed by removing impurities, after which the juice is heated and concentrated, and then cooled to solidify. Accordingly, the aforesaid minor components remain in sucrose without being removed. However, due to its strong flavor and coloring occurring in the refining process, there is a problem that it may not be used widely in foods. Brown soft sugar is almost equal to the refined sugar in contents of nutrition components and minerals, and in flavor. Sugar enriched with nutritional components and minerals lacks a natural balance.

It has been thus desired to decrease the strong flavor and coloring with the passage of time in the brown sugar and the O-tung, and to improve quality of the noncentrifugal sugar to be used widely in foods. This may also be good from a viewpoint of effective use of food resources. However, there are a very few attempts to improve the quality of the noncentrifugal sugar. Japanese Patent Application Laid-open No. Sho-52-120137/1977 describes a process for the effective preparation of a good flavored nutritional sugar by ultrafiltration of the cane juice. This application, however, gives attention mainly to nutritional components contained in the nutritive sugar, improvement of the quality of taste is little considered and there is no discussion on coloring of the products during storage. Japanese Patent Application Laid-open No. Sho-60-30700/1985 discloses a method of removing salty and bitter tastes components and of maintaining nutrition and flavor components in the brown sugar by means of electrodialysis in combination with a prior method for the brown sugar preparation. Japanese Patent Application Laid-open No. Sho-60-133900/1985 discloses a process for the preparation of a less colored brown sugar, wherein after removing foreign substances by filtration, the cane juice is heated to be concentrated, after that the juice is heated again with addition of a small amount of milk lime, and then cooled to solidify. However, any of the applications described above does not refer to the changes in flavor and color of the noncentrifugal sugar compositions with the passage of time.

Further, in general, many people desire sugar products that are easy to handle and are easy to dissolve. Meanwhile, food manufactures and sellers desire granule-formed sugar which is easy to fluidize and is difficult to solidify. The term "solidification" refers to a state of sugar in which sugar solidifies to lose fluidity, and is a large factor of deteriorating the commercial value of sugar products. Accordingly, less solidification is a very preferable property of sugar.

There is still needed a process to prepare, at lower costs, granule-formed sugar which has a function as a healthy food, maintaining the original flavor and nutritional components.

A process for the preparation of sugar mainly comprises a step of preparing sugar syrup, a step of heating and evaporating the sugar syrup, a step of crystallizing the sugar syrup to obtain sugar, and a step of drying and conditioning the sugar. If the step of drying and conditioning sugar syrup is not sufficiently carried out on sugar which has been transformed to crystallize by, for example, boiling, and pelletized or granulated, a problem of solidification happens during the storage of the product to lose its commercial value.

The step of drying and conditioning is composed of three sub-steps: drying with a dryer, cooling with a cooler and conditioning in a hopper. More specifically, in the drying procedure, sugar products are dried with a dryer in order to decrease the moisture of the sugar products so as to prevent them from solidifying. For example, in the case of granulated sugar, the moisture is about 0.6 to 1.5% by weight when it leaves a centrifugal machine. It is then dried to a moisture of about 0.02% by weight with a dryer at about 50 to 75° C. If the sugar product is fed directly to a hopper without being dried with a dryer, there is high possibility of solidifying because of its uncontrolled moisture.

Next, in the cooling procedure, the sugar product dried with a dryer is cooled with a cooler to about 35 to 45° C. If the sugar product dried with a dryer is fed directly to a hopper without the cooling procedure, there is high possibility of solidifying due to heat held in the sugar product and/or to moisture remaining partly.

In the conditioning procedure, the cooled sugar product is homogenized in a hopper in order to level its moisture and thereby to prevent it from solidifying. In general, the sugar product cooled with a cooler is conditioned in a hopper in which dry air is supplied, to remove moisture which is contained in crystals of sugar and which would cause the sugar to solidify. After the conditioning, the sugar is packed in a bag and shipped.

Various dryers are well known to be used in the drying procedure, such as fluidized bed dryers, flash jet dryers and rotary dryers. Various sugar coolers are known to be used in the cooling procedure, such as rotating-type drum coolers and vacuum-type belt coolers. However, all of the machines takes high costs for equipment. Accordingly, installation of the equipment may lead to increased costs of the product.

As the step of drying and conditioning requires many machines to be installed, i.e., a dryer, a cooler and a hopper, large equipment costs arise. Thus, this step contains many cost-increasing factors. There are some proposals for improving the drying procedure, for example, a method of drying with a fluidized bed dryer, followed by conditioning in a hopper (Japanese Patent Publication No. Hei-1-16480/1989); a method of drying with a drum dryer (Japanese Patent Publication No. Sho-55-9200/1980); a method of drying with a rotary dryer (Japanese Patent Application Laid-Open No. Sho-60-256399/1985); and a method of continuous drying with a crystallizer for a prolonged time (Japanese Patent Application Laid-Open No. Sho-57-138400/1982). In all of these methods, a dryer is used or a crystallizer is operated in a prolonged time and, therefore, there are some problems such as low commercial productivity, undesirable physical properties in granule-formed sugar prepared (e.g., wide particle size distribution, low fluidity or easy solidification). Thus, there has been no proposal for improving the preparation process by simplifying the step of drying and conditioning sugar, while maintaining the quality of the product. A process for drying and conditioning sugar at lower costs is desired.

A purpose of the present invention is to provide a non-centrifugal sugar composition which maintains natural flavor as original from a sugar cane and which is less colored and excellent in stability with the passage of time.

Another purpose of the present invention is to provide a process for the preparation of a noncentrifugal sugar composition which maintains natural flavor as original from a sugar cane and which is less colored and excellent in stability with the passage of time.

Another purpose of the present invention is to provide, at lower costs, a process for the preparation of granule-formed sugar which maintains original flavor and nutritional components and which is easy to handle.

BRIEF DESCRIPTION OF THE INVENTION

The present inventors have made a lot of researches to improve the quality of noncentrifugal sugar. As the results, we have found that by greatly decreasing a moisture of a composition so comprising cane juice and sucrose and/or liquid sucrose as to have particular properties produced is a noncentrifugal sugar composition which is excellent in stability with the passage of time and has rich flavor. These findings have led to the present invention.

The present invention first provides noncentrifugal sugar composition comprising cane juice and sucrose or liquid sucrose or both, characterized in that the color value is not more than AI2000, the purity is 93.1 to 86.0% by weight and the moisture is not more than 2.0% by weight.

The present invention secondly provides a process for the preparation of a noncentrifugal sugar composition, characterized in that the process comprises the following steps: cane juice is filtered; a pH of the juice is adjusted to 5.0–6.0; sucrose or liquid sucrose or both is added to adjust a purity of the mixture to a range of 95.1 to 87.0% by weight; the mixture is heated and evaporated; and then the mixture is cooled to solidify with a strong shearing force being applied to obtain granules.

The present inventors also have found that when a purity of sugar syrup before a heating and evaporation step is adjusted to 87.0 to 95.1 and the sugar syrup after a heating and evaporation step is crystallized with a strong shearing force being applied to obtain granule-formed sugar, a process of drying and conditioning sugar may be simplified into only one procedure with a hopper which corresponds to the prior conditioning procedure, without using a costly dryer or cooler. We have also found that the granule-formed sugar thus obtained has functions as a healthy food having original flavor and nutritional components and is excellent in fluidity and hard to solidify. These findings have led to the present invention.

The present invention thirdly provides a process for the preparation of granule-formed sugar which comprises a step of preparing sugar syrup, a step of heating and evaporating the sugar syrup, a step of crystallizing the sugar syrup to obtain sugar and a step of drying, cooling and conditioning the sugar, characterized in that a purity of the sugar syrup obtained from the step of preparing sugar syrup is adjusted to a range of 87.0 to 95.1% by weight before the step of heating and evaporating the sugar syrup, the crystallization of the sugar syrup is carried out with a strong shearing force being applied to obtain granule-formed sugar, and the step of drying, cooling and conditioning the sugar is carried out in a way where the granule-formed sugar obtained from the step of crystallization is fed and dried in a hopper through the bottom of which dry air is blown in.

PREFERRED EMBODIMENTS OF THE INVENTION

Figure 1:
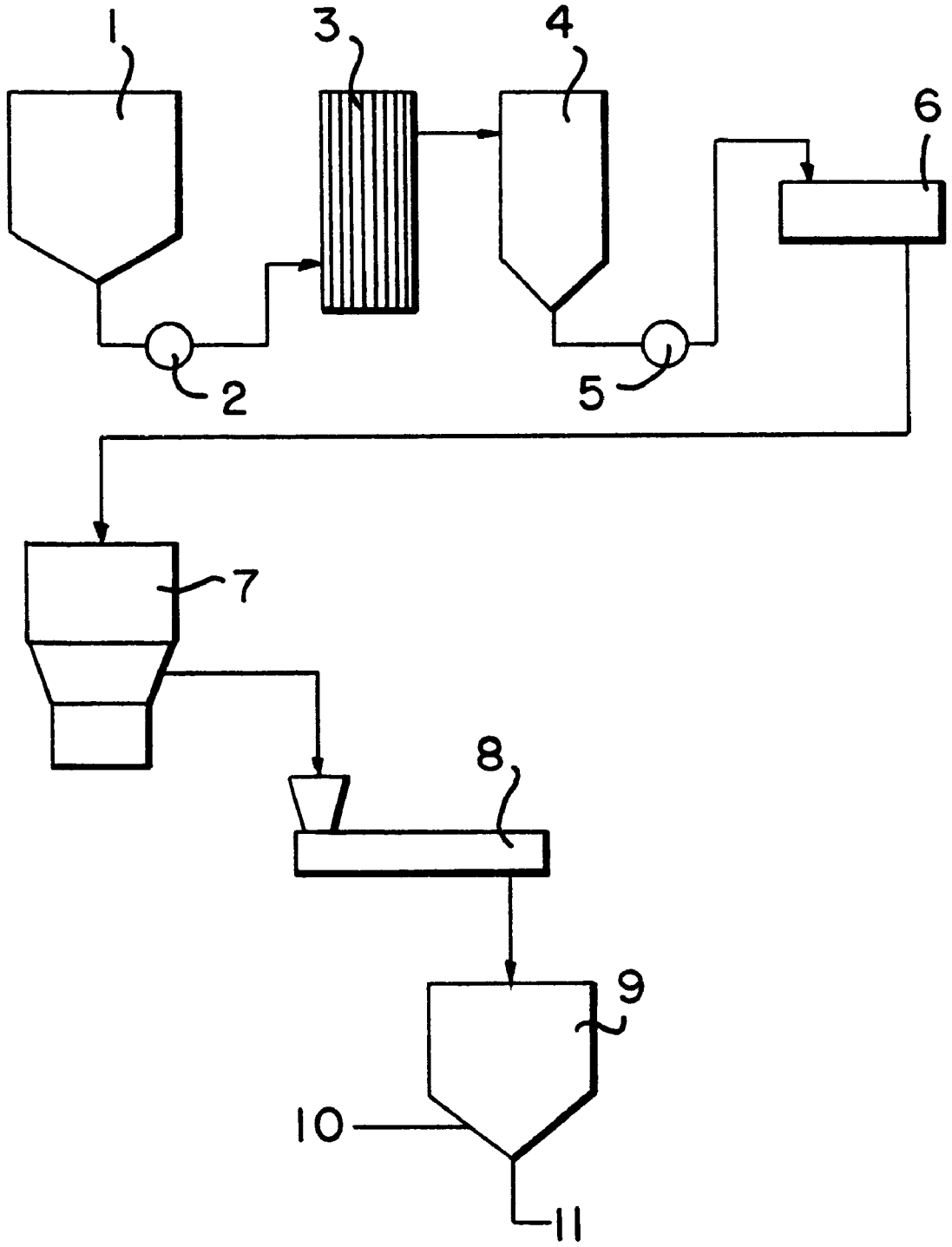
FIG. 1 shows an apparatus and a schematic procedure used in Example 3 for preparing the present composition.
Figure 2:
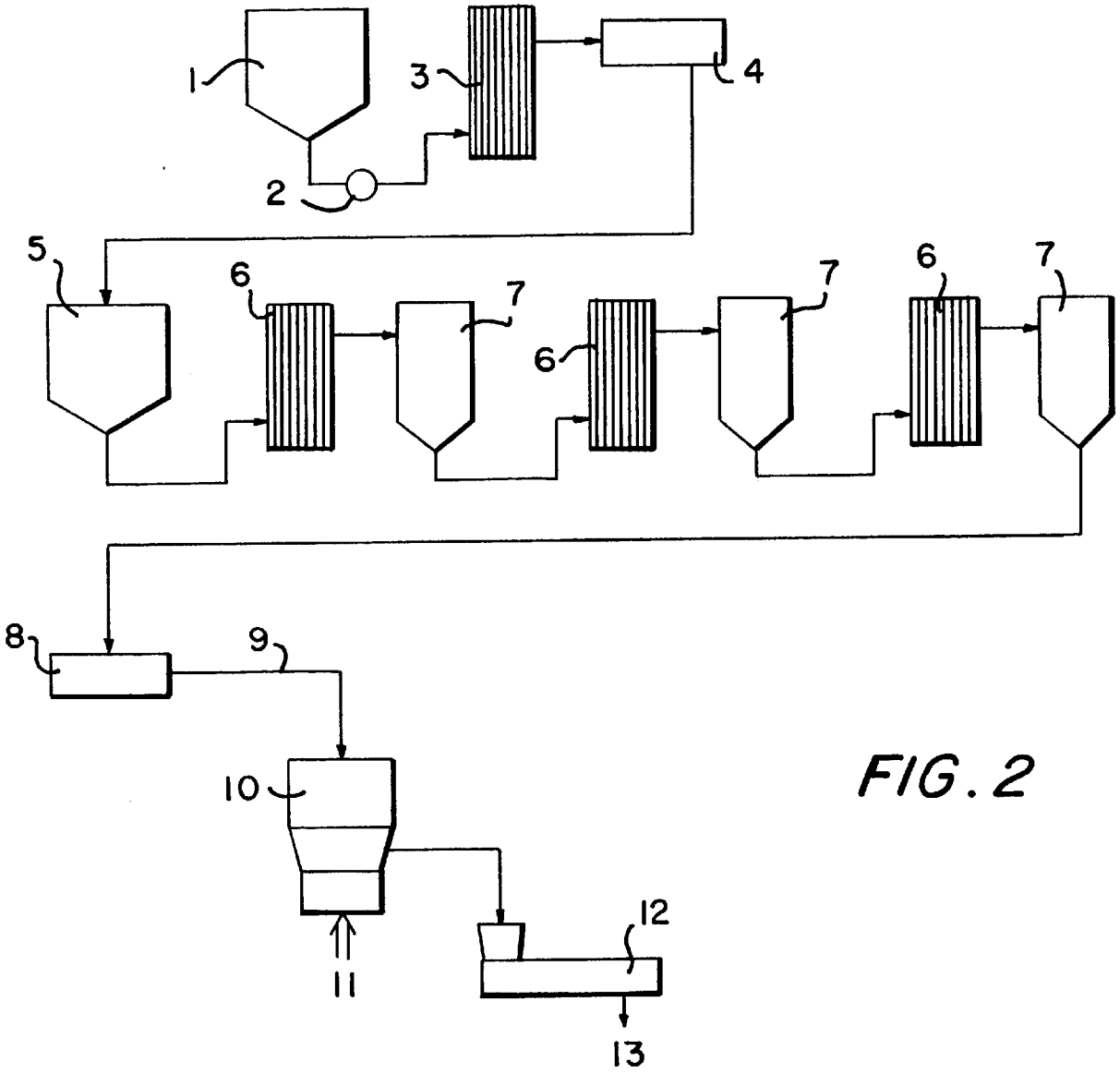
FIG. 2 shows an apparatus and a schematic procedure used in Example 6 for preparing the present granule-formed sugar.

The present composition contains cane juice and sucrose and/or liquid sucrose. A weight ratio of the cane juice to sucrose (and/or liquid sucrose) depends on purity of the cane juice. The composition should contain the cane juice and sucrose (and/or liquid sucrose) so as to have a purity of 93.1 to 86.0% by weight of the whole composition. Preferably, the purity is 93.1 to 89.0% by weight. If the purity is too high, sugar cane flavor may almost disappear. If the purity is too low, a production rate on machinery in a continuous process is lower, and adhesion of solid materials on the inside of the machine occurs remarkably as well. These decrease the efficiency of the production. The purity is determined according to the following formula:

$$\text{purity}=(\text{polarization}/\text{total solid})\times 100$$

wherein the polarization is measured in the Spencer method which is described in "Handbook of Sugar Production", edited by the Research Society of Japan Sugar Refineries' Technologists, Asakura Shoten, Jun. 30, 1962; and the total solid is indicated in % (w/w).

In general, in order to obtain the aforesaid purity, a percent ratio of a solid weight of the cane juice to a weight of the noncentrifugal sugar composition, that is, (solid weight of the cane juice)/(the noncentrifugal sugar composition weight)×100, is adjusted to 30–70% by weight.

In the invention, the terms "cane juice" mean mill juice obtained by crushing sugar cane or extracted juice obtained by extracting sugar cane.

Types or forms of sucrose and/or liquid sucrose are not restricted to particular ones. Use may be made of one or more of granulated sugars, raw sugars, white soft sugars, which are crystal sugars, and fine liquor which is liquid sugar.

It is preferred that in the present composition, for example, a reducing sugar content is 3.5–6.5% by weight and an ash content is 1.1–2.5% by weight. This is, however, not restrictive. The reducing sugar content is determined in the methylene blue method. The reducing sugars in the present composition include glucose, fructose, and so on. The ash content is indicated in a value determined as sulfate salts. Elements which may be contained in the present composition include calcium, potassium, magnesium, etc.

The present composition may further contain vitamins such as $B_1$, $B_2$, $B_6$ and pantothenic acid in addition to the aforesaid components. These vitamins are components originated from cane juice.

In the present composition, color value is not more than AI2000, preferably not more than AI1500. If the color value is too high, coloring is strong, then application of the composition is restricted. There is no particular lower limit in the color value, but it is usually at least AI600. The color value (AI) is obtained according to the description in "Handbook of Sugar Production", edited by the Research society of Japan Sugar Refineries' Technologists, Asakura Shoten, Jun. 30, 1962, as follows:

A sample is dissolved in water to prepare a test solution of about 25% (w/w) concentration, and then the pH thereof is adjusted to 7.0, of which Brix degree (Bx) is measured with a refractometer for Bx measurement. Subsequently, absorbance (ABS) of the test solution (pH 7.0) is measured at 560 nm on a spectrophotometer. From these values measured, AI is calculated according to the following formula (2):

$$AI=(1000\times ABS\times 100)/(b\times(Bx)\times g) \quad (2)$$

wherein ABS is absorbance; b is an optical path length (cm) of a cell in the spectrophotometer; Bx is a Brix degree (g/g); and g is the specific gravity (g/ml) of the test liquid.

When the color value is within the aforesaid range, the composition has yellowish white to light brown color. Accordingly, it is possible to use the present composition in wider applications, compared to the prior products of noncentrifugal sugars, such as brown sugar and O-tung.

The moisture value of the present composition is not more than 2.0% by weight, preferably 1.3% by weight. If the moisture value is too high, it is impossible to prevent it from coloring and deteriorating in flavor with the passage of time. The moisture is preferably at least 0.4% by weight owing to the restriction in the preparation procedure that a production efficacy lowers as the drying time is longer, or for the reason that natural flavor of a sugar cane decreases during a long drying treatment. The moisture value is measured using a method of drying under reduced pressure at 75° C. for 3 hours.

It has been found that when the moisture value is thus controlled, it is possible to prevent the composition from coloring and deteriorating in flavor with the passage of time; in addition, the composition exhibits surprisingly better fluidity, which is an important factor for sugar products, than that of the prior art noncentrifugal sugar; and this fluidity is nearly same as that of granulated sugar which is known to exhibit good fluidity among sugar products. Good fluidity is a very preferable characteristic because the product obtained is then easy to handle in use and a working efficiency is good in the preparation of the product, particularly in packaging procedures.

When the moisture value is controlled as mentioned above, there is another advantage that solidification scarcely occurs. As the solidification is a main factor to deteriorate commercial values of sugar products, less solidification is a very preferable characteristic. In addition, granule products prepared from the present composition also have an excellent characteristic of less solidification. It has been found that powdery products which are obtained by grinding on a mill or screening the above granule products and which have an average particle size of, for example, 280 to 310 μm have an excellent characteristic of less solidification, compared to a so-called "fine granule" which is a screened sucrose or granulated sugar with an average particle size of 270 to 310 μm and is easily solidified, although both have nearly the same average particle size.

The present composition is preferably prepared as follows:

First, as pretreatment, cane juice is filtered in order to remove foreign substances without purifying it with lime as in the prior art. The filtration manner is not restricted to particular one. Any method widely used in the food industry such as screen filtration, diatomaceous earth filtration, precision filtration and ultrafiltration may be preferably applied.

The pH of the cane juice after the filtration treatment becomes 4.8–5.8 depending on the cultivars of the sugar cane. In order to prevent decomposition of sugar in a later heating and concentration process, it is preferred to adjust the pH to 5.0–6.0. If the pH is too low, sucrose decomposes remarkably in heating, whereby crystallization of solid sugar tends to become difficult. If pH is too high, there is a tendency that the flavor changes to brown sugar-like flavor in the later concentration process, or coloring worsens.

Next, sucrose and/or liquid sucrose is mixed to the above cane juice to adjust the purity to the aforesaid range. The mixture is then heated to be concentrated. In general, the heating temperature is preferably 125–130° C.

Subsequently, the concentrated liquid sugar is cooled to crystallize. The cooling and crystallization may be carried out while applying a strong shear force with the aid of, for example, a universal mixer or nauta mixer in the case of batch production, or an extruder, kneader or turbulizer in the case of continuous production. Thus, granulated product may be obtained. It may be dried, if needed, to adjust its moisture value to the aforesaid range. The composition obtained may be in any form depending on the treatment. In the case where the cooling is carried out with stirring, the composition is in a granule form, which may be ground on a mill to obtain powder.

The present composition keeps natural flavor originated from sugar cane. As it has no strong flavor nor coloring like brown sugar has, it may be used not only in any particular foods, but widely in general foods. Its applications are in various sweeteners in powder, granule, cube, paste, liquid, and any other forms, and in foods containing sweeteners, such as drinks, e.g. coffee, tea, soft drinks, aerated drinks, dairy drinks, and sweet drinks from fermented rice; candies e.g. hard candies and soft candies; confectioneries e.g. tablet sweet, fondant, icing, jelly, mousse, chocolate, cookie, cake, ice cream, sherbet and chewing gum; and sweetened foods e.g. sweet pickles, dressing and various sauces. Besides the foods, it may be used in other applications, for example, in oral drags including Chinese medicines, e.g., in a sugar-coated tablet or for seasoning a tablet body.

As the present composition is excellent in fluidity as mentioned above and also excellently easy to be formed into tablets, it may be an excellent material for tablet sweets.

Further, when the present noncentrifugal sugar composition is applied to foods, the following effects have been recognized.

First, the present composition has effects of improving acrid taste of soy sauce and giving deepness and roasted aroma to the taste of soy sauce. These effects are attained by compatibility of the present composition with soy sauce. These effects may be exhibited, for example, when the present composition is used in sauce for Mitarashi-dango, i.e. dumplings with brown sauce, seasonings for laver or sauce for Donburi, i.e. rice in a bowl which is covered with cooked materials.

Second, the present composition has an effect of suppressing undesirable odors of food ingredients, i.e. deodorant effect. Accordingly, when the present composition is used for sweetness in cooking, undesirable odors from food ingredients, for example, onions, meats, or fishes, may be suppressed to improve the quality of taste in meals. For example, when the present composition is used for seasonings for meats such as grilled meats or grilled chickens, seasonings for fishes, canned meats or fishes, or Tsukudani, i.e. foods, such as fishes, boiled down in soy sauce, this effect may be exhibited.

Although details have not been known about components which are effective for the deodorization, it is presumed that this is due to minor components, such as saponin, originated from a sugar cane.

Third, the present composition has a flavor originated from a sugar cane which emphasizes a desirable taste that food ingredients have. For example, when the present composition is used in instant coffee, its taste feels like that of coffee roasted with charcoal. When it is used in sweet potatoes or pumpkin croquettes, flavor from food ingredients is enhanced. The above effect may be thus exhibited.

Fourthly, flavor which the present noncentrifugal sugar composition has may be exhibited as such in foods and, in addition, the flavor originated from the present noncentrifugal sugar composition may change during cooking to generate a desirable taste. For example, when the present composition is used in hard candies, Rakugan, i.e. rice-flour cakes, or skin of manju, i.e. buns with a bean-jam filling, these effects may be exhibited.

Fifthly, the present noncentrifugal sugar composition has an effect of coordinating entire taste of a cooked food to make it more delicious, when it is used in cooking. For example, when it is used in dressing sauce or sauce for cooled Chinese noodle, acidity is softened to coordinate their taste. The above effect may be thus exhibited.

The present composition has a remarkably small moisture, compared to noncentrifugal sugar products of the prior art originated from cane juice. For example, a moisture value is about 5–8% by weight in brown sugar lump, and about 3–6% by weight in O-tung. (See Table 1 below. Table 1 shows examples of analysis data of noncentrifugal sugar products originated from a sugar cane. These data are cited from "Process for the Preparation of Cane Sugar", Korin Shoin, Apr. 5, 1963, page 7, Table 1.6 for brown sugar lump and page 8, Table 1.9 for O-tung). Meanwhile the moisture is not more than 2% by weight in the present composition. Although chemical mechanism in which the moisture of the noncentrifugal sugar changes its color value and flavor is not known, it is surprising that when the moisture is not more than 2% by weight, the coloring and deterioration of the flavor with the passage of time may be reduced in the composition of noncentrifugal sugar and centrifugal sugar with the aforesaid purity and color value. In the previous studies for improving the quality of noncentrifugal sugar, nobody refers to the relation between the change with the passage of time in flavor or coloring and the water content.

TABLE 1

| Sugar | moisture, % | Polarization (°) | Purity, % | Reducing Sugars, % | Ash Content, % |
|---|---|---|---|---|---|
| Brown Sugar Lump (First Class) | 5.7 | 86.0 | 90.8 | 2.1 | 1.37 |
| Brown Sugar Lump (Second Class) | 6.9 | 82.3 | 88.4 | 2.4 | 1.66 |
| Brown Sugar Lump (Third Class) | 7.7 | 78.6 | 85.2 | 7.1 | 1.49 |
| O-tung (Brown Sugar) Product A | 3.0 | 84.0 | 86.6 | 4.6 | 2.04 |
| O-tung (Brown Sugar) Product B | 6.1 | 80.4 | 85.6 | 5.1 | 1.45 |

A preferred process for preparing granule-formed sugar will be described below.

The present process for the preparation of granule-formed sugar comprises a step of preparing sugar syrup, a step of heating and evaporating the sugar syrup, a step of crystallizing the sugar syrup and a step of drying, cooling and conditioning sugar. The present invention improves the prior processes for the preparation of granule-formed sugar to shorten the prior processes. In the present process, the step of drying, cooling and conditioning sugar may be carried out only with a hopper without steps using a dryer and a cooler. This is due to the restricted purity of sugar syrup of the a particular range and the strong shearing force applied in crystallization.

The step of preparing sugar syrup and the step of heating and evaporating the sugar syrup may be carried out in a way conventional in this field. In the present process, it is necessary to adjust a purity of the sugar syrup obtained from the step of preparing the sugar syrup before the step of heating and evaporating the sugar syrup to a range of 87.0 to 95.1% by weight, preferably 90.0 to 95.1% by weight. When the purity of the sugar syrup is adjusted to the aforesaid range, the purity of a product (granule-formed sugar product) may be 86.0 to 93.1% by weight, preferably 89.0 to 93.1% by weight because some parts of sucrose are decomposed in the subsequent steps. If the purity is too high, the granule-formed sugar has less flavor or less nutritional components. Further, in the step of drying, cooling and conditioning sugar, if transformed and crystallized granule-formed sugar is introduced into a hopper with its moisture and temperature remaining high, there is a high risk that it solidifies with each other because of its high purity. Accordingly, it is impossible to prepare the envisaged granule-formed sugar which may be dried directly in a hopper. Meanwhile, if the purity is too low, in the step of crystallizing the sugar syrup, for example, in a horizontal continuous crystallizing machine with high speed paddles, a continuous production speed decreases and, furthermore, adhesion of solid materials to the inside of the machine occurs remarkably. In addition, in the next step of drying, cooling and conditioning the sugar, a larger amount of dry air and more drying time are needed, which results in the need for a larger hopper or more hoppers. This increases costs.

As the sugar syrup, use is made of sugar syrup prepared by adding sucrose and/or liquid sucrose to cane juice to adjust its purity to 87.0 to 95.1% by weight. A weight ratio of the sucrose and/or liquid sucrose to the cane juice is dependent upon the purity of cane juice. In general, in order to obtain the aforesaid purity, a percentage of a solid weight of the cane juice to a weight of the granule-formed sugar, that is, (solid weight of the cane juice)/(the granule-formed sugar weight)×100, is adjusted to 30–70% by weight.

In the step of preparing sugar syrup, the sugar syrup having the aforesaid purity may be obtained, for example, in the manner as mentioned above, that is, by filtering cane juice and then adjusting the pH of the juice to 5.0 to 6.0, to which sucrose and/or liquid sucrose is added. Alternatively, the sugar syrup may be prepared by subjecting cane juice to a clarification procedure in which milk lime is added to the cane juice and the juice is added, and then adding sucrose and/or liquid sucrose. However, the former (without a clarification procedure with milk lime) is preferred because the granule-formed sugar obtained finally is better in quality (i.e., coloring is suppressed and the flavor and nutrition components remain) and, therefore, may be used widely. The step of preparing the sugar syrup may be preferably carried out as follows: first, cane juice is filtered in order to remove foreign substances without clarifying it with milk lime. The filtration method includes those widely used in the food industry such as screen filtration, diatomaceous earth filtration, precision filtration and ultrafiltration. Among these, the ultrafiltration is preferred. Most preferred is the ultrafiltration with a fractionating molecular weight of 150,000 or less, more particularly 30,000 to 150,000. In the ultrafiltration, use may be preferably made of tubular type ultrafilter membranes, plate-type ultrafilter membranes, spiral ultrafilter membranes and hollow yarn-type ultrafilter membranes.

When sugar syrup having a high purity is obtained, it is possible to conduct the subsequent transformation and crystallization even without the filtration. However, in the case where sugar syrup having a particular purity as mentioned above is obtained, it is preferred to carry out the aforesaid ultrafiltration in order to attain stable and efficient production in the subsequent crystallization process, for example, with a horizontal continuous crystallizing machine with high speed paddles. Disadvantages in the case where filtration is not carried out are thought to be due to impurities or suspended materials such as high molecular weight polysaccharides or colorants originated from cane juice.

The pH of the cane juice after the filtration treatment becomes 4.8–5.8 depending on the cultivars of the sugar cane. In order to prevent decomposition of sugar in the next step of heating and evaporating the sugar syrup, it is preferred to adjust the pH to 5.0–6.0. If the pH is too low, sucrose decomposes remarkably in heating, whereby purification of solid sugar tends to become difficult. If the pH is too high, there is a tendency that the flavor changes to brown sugar-like flavor in the next step of heating and evaporating the sugar syrup, or coloring worsens.

The purity of the cane juice after the pH adjustment is adjusted to 87.0 to 95.1% by weight using sucrose and/or liquid sucrose. The sugar syrup thus obtained is fed to the next step of heating and evaporating the sugar syrup.

The step of heating and evaporating the sugar syrup may be preferably carried out in the following manner. That is, a three-step plate-type heat exchanger is used to concentrate the sugar syrup, where two steps of concentration under reduced pressure and one step of concentration under atmospheric pressure are conducted in this order. Then, the concentration may be efficiently carried out with the decomposition of sucrose and the coloring being suppressed. In the plate-type heat exchanger having three steps, steam energy is more efficiently used, compared to a plate-type evaporator station of only one step or a reduced pressure evaporator station of only one step, because the steam generated in the first step is reused in the second step. When the concentration is carried out in the plate-type heat exchanger having three steps, for example, sugar syrup having a purity of 87.0 to 95.1% by weight from the prior step is heated to be concentrated from about Bx 28 to about Bx 40 in the first plate-type heat exchanger. The concentrate is separated from steam with a vapor separator under reduced pressure. The concentrate obtained is fed to the second plate-type heat exchanger and heated to be concentrated from about Bx 40 to about Bx 65. Meanwhile, the steam separated in the first vapor separator is supplied to a steam site of the second plate-type heat exchanger. After the second step, the concentrate is separated from steam with a vapor separator under reduced pressure. The concentrate obtained is heated to be concentrated from about Bx 65 to about Bx 93 in the final plate-type heat exchanger. Under atmospheric pressure, the concentrate obtained is separated from steam with a vapor separator. The sugar syrup concentrated to about Bx 93 is fed to the step of crystallizing the sugar syrup and is transformed and crystallized. Particularly, in the case where a horizontal continuous crystallizing machine with high speed paddles is used in the next step of crystallizing the sugar syrup, it is preferred to concentrate the sugar syrup to a Brix range of about 90.5 to 95.3 in the step of heating and evaporating the sugar syrup in order to attain better transformation and crystallization. If the concentration does not sufficiently progress, that is, a Brix is too low, it is sometimes difficult to carry out the transformation and crystallization with a horizontal continuous crystallizing machine with high speed paddles. If concentration is carried out excessively, that is, a Brix is too high, the fluidity becomes bad before entering the horizontal continuous crystallizing machine with high speed paddles and, consequently, solidification occurs. This causes a problem that pipes are clogged.

In the case where a horizontal continuous crystallizing machine with high speed paddles is used in the next step of crystallizing the sugar syrup, it is preferred to determine, in advance, the conditions of attaining the Brix of the aforesaid range after the concentration in the final plate-type heat exchanger, because the Brix affects the conditions of transformation and crystallization very much. That is, as the relation between liquid temperature and Bx of sugar liquid under atmospheric pressure is well known, it is possible to know the Bx value before sugar syrup enters a horizontal continuous crystallizing machine with high speed paddles from an outlet temperature of a concentrate of the final plate-type heat exchanger (i.e., inlet temperature of the vapor separator), based on the conversion table. For example, when one wants to feed sugar syrup of Bx 93 to a horizontal continuous crystallizing machine with high speed paddles, the outlet temperature of the concentrate of the plate-type heat exchanger is set to about 127° C. by reference to the conversion table. In this manner, it is possible to carry out the step of heating and evaporating the sugar syrup efficiently by monitoring the outlet temperature of a concentrate of the final plate-type heat exchanger, that is, inlet temperature of the vapor separator, without need of directly measuring the Bx after the concentration. Meanwhile, it is possible to minimize decomposition of sucrose and coloring in the sugar syrup after heated and evaporated and to concentrate the sugar syrup to a Bx which is suitable to the step of crystallizing the sugar syrup in a shorter time, owing to the aforesaid adjustment of the pH of cane juice and the aforesaid manner of heating and evaporating the sugar syrup.

The sugar syrup after concentrated is then fed to the step of crystallizing the sugar syrup. In the present invention, it is necessary to carry out the transformation and crystallization while applying a strong shearing force. Means for carrying out it include a universal mixer, nauta mixer, extruder, kneader, colloidal mill or horizontal continuous crystallizing machine with high speed paddles. Among these, the horizontal continuous crystallizing machine with high speed paddles is preferred. The horizontal continuous crystallizing machine with high speed paddles is a kind of continuous mixing and dispersing machine and is used as a crystallizing machine in the present process. Typical example of it is turbulizer.

The crystallization using the horizontal continuous crystallizing machine with high speed paddles is preferably carried out in the following manner. In the horizontal continuous crystallizing machine with high speed paddles, heated dry air is introduced. A relative humidity of the heated dry air is RH 10% or less. An air volume of the heated dry air is 9 to 30 $Nm^3$/min. when the horizontal continuous crystallizing machine with high speed paddles is operated at a discharge speed of granule-formed sugar of 1 ton/hour. With the aforesaid relative humidity and air volume, it is possible to keep the moisture of the granule-formed sugar from the horizontal continuous crystallizing machine with high speed paddles at 2.5% by weight or below. Accordingly, the moisture of the granule-formed sugar from the horizontal continuous crystallizing machine with high speed paddles can be made uniform and lower. Then, the next step of drying, cooling and conditioning sugar may be carried out satisfactory. The temperature of the heated dry air is preferably at least 60° C., more preferably at 82 to 88° C. If the temperature of the heated dry air is too low, the sugar syrup is cooled to become a candy-like state before the crystallization occurs. Then, the candy-like materials adhere to the inside of the horizontal continuous crystallizing machine with high speed paddles. This increases a load on the machine and causes the machine to stop. Further, due to the presence of the dry air of a too low temperature, evaporation of water by heat of crystallization becomes insufficient. In addition, steam generated in the crystallization cannot go out of the crystallizing machine as gas and is condensed into free water. Accordingly, the granulate-formed sugar leaves the outlet of the crystallizing machine in a creamy state. Meanwhile, if the temperature of the heated dry air is too high, drying progresses too much to cause problems such as occurrence of a candy-like state, decomposition of sucrose and coloring. In addition, flavor is lost. A peripheral speed of paddles, that is, linear velocity of paddles, of the crystallizing machine is generally 25 to 45 m/sec., preferably 30 to 40 m/sec. so as to narrow particle size distribution. If the speed of paddles is too low, the shearing force is weak and, therefore, complete crystallization cannot be attained and the sugar from the crystallizing machine tends to be creamy state, so that the production cannot be continued. If the speed of paddles is too high, the shape of the transformed and crystallized sugar tends to be of a fine powder rather than granule form. These fine powder has problems that when dry air is blown in a hopper, duct arises easily to worsen operability; dust arises also in use; and the powder solidifies in a distribution stage to lose its commercial value.

The methods which have been used in the prior art for concentration and crystallization are as follows: a so-called transformation method in which a combination of a plate-type evaporator, a colloidal mill (or homogenizer), a conveyor belt and a crusher is used (Japanese Patent Publication No. Sho-55-9200/1980); a method of quick stirring (Japanese Patent Application Laid-Open No. Sho-52-120137/1977); a method of impactive mixing (Japanese Patent Application Laid-Open No. Sho-57-138400/1982); a method with a continuous screw extruder (Japanese Patent Application Laid-Open No. Sho-60-256399); and a method of using a combination of a concentrator under reduced pressure, a beater crystallizer and a crusher (U.S. Pat. No. 3,194,682). The granule-formed sugar prepared by these methods are not suitable for the next step of drying, cooling and conditioning sugar only with a hopper. These sugars have the following disadvantages: the granule-formed sugar cannot be homogeneously dried because the particle size is large and the particle size distribution is broad. The fluidity is bad due to the broad particle size distribution, so that they are not suitable for the step of direct drying, cooling and conditioning of sugar in a hopper. They need much time for being dried because of too much moisture. Further, these methods are not suitable for continuous operation in an industrial scale for a long time. In Japanese Patent Publication No. Hei-1-16480/1989, granule-formed sugar is prepared from sugar syrup having a purity of 97.1 to 99.9 in an industrial scale with a horizontal continuous crystallizing machine with high speed paddles. However, such granule-formed sugar having a high purity has a high risk that it solidifies in a hopper.

The granule-formed sugar obtained from the step of crystallizing sugar syrup is fed to the next step of drying, cooling and conditioning sugar. A conveyor is generally used for transporting the granule-formed sugar crystallized in the step of crystallizing sugar syrup to a hopper used in the step of drying, cooling and conditioning sugar. The conveyor preferably comprises a means for efficiently removing vapor which is generated from the granule-formed sugar during it is transported. Such efficient removing of vapor may be carried out by ventilation, i.e. by blowing and sucking air. The moisture of the granule-formed sugar transported may be controlled by controlling the amount of air. The conveyor includes, for example, a screw conveyor, a vibration conveyor, a continuous flow conveyor and a belt conveyor. A moisture value of the granule-formed sugar just before entering the hopper is preferably at most 2.0% by weight.

Next, the step of drying, cooling and conditioning sugar will be described below. The granule-formed sugar from the prior step of crystallizing the sugar syrup has a temperature of about 110 to 120° C. As the vapor generated from the granule-formed sugar is efficiently removed during the transportation to a hopper with the conveyor and the granule-formed sugar itself radiates heat, it is cooled to about 100° C. In the present invention, the granule-formed sugar is introduced from the conveyor into a hopper through the bottom of which dry air is blown in and directly dried, cooled and conditioned there, without passing through a dryer or a cooler as in the prior art. A temperature of the dry air which is blown in the hopper is preferably about 40 to 50° C. A relative humidity of the dry air is preferably RH 35% or less at this temperatures. The granule-formed sugar is dried in the hopper to a moisture value of at most 1.3% by weight, preferably at most 0.9% by weight and at least 0.4% by weight. In order to regulate the moisture value of the granule-formed sugar to the aforesaid value, the relative humidity of the dry air is necessarily at most RH 35%. The moisture value of the granule-formed sugar just before entering the hopper from the conveyor is preferably at most 2.0% by weight in order to prevent it from solidifying in the hopper.

The hopper used in the present invention includes a sugar bin, a silo, a reservoir or a bin.

The granule-formed sugar prepared by the present process may be used in wider applications, compared to the prior noncentrifugal sugar such as brown sugar and O-tung, because its color value is not more than AI 2000. Accordingly its application for food is not restricted to particular ones, but may be used in general.

The granule-formed sugar prepared by the present process has a moisture value of at most 1.3% by weight, preferably at most 0.9% by weight. If the moisture value is too high, it is impossible to prevent the granule-formed sugar from coloring or losing its flavor with the passage of time. However, the moisture is preferably at least 0.4% by weight, because natural flavor of sugar cane decreases during a long drying treatment if the drying is carried out in such conditions that the moisture becomes too low. The moisture is measured using a method where drying is conducted under reduced pressure at 75° C. for 3 hours.

The granule-formed sugar prepared by the present process has very preferable characteristics. That is, the particle size distribution is narrow and the coefficient of variation is small. In addition, a noncrystal part, i.e. syrup part, is present in a very stable state in the granule-formed sugar. Accordingly, it is excellent in fluidity and hard to solidify. The granule-formed sugar is easy to handle in use as well as keeps its quality in storage and its working efficiency is good in the preparation of the product, particularly in packaging procedures.

In the process as mentioned above, it is possible to carry out a step of drying, cooling and conditioning sugar only with a hopper without steps using a dryer and a cooler. This owes the fact that the purity of sugar syrup is restricted to the particular range and the crystallization is carried out with a strong shearing force being applied. For example, Japanese Patent Publication No. Hei-1-16480/1989 discloses a combination of a pressurized thin film evaporator station and a horizontal continuous crystallizing machine with high speed paddles. The sugar syrup used in that publication has a high purity, 97.1 to 99.9%. Accordingly, when the sugar from the crystallizing machine is introduced via a screw conveyor to a hopper, it solidifies in a hopper with high possibility and, therefore, it is difficult to dry. Further, such a product has high possibility of solidifying during storage.

Meanwhile, when products such as boiled sugar, for example, granulated sugar or brown soft sugar, or sugar which is crystallized by a granulation method other than the present process are dried directly in a hopper, they solidify in the hopper regardless of their purity.

The present invention will be further elucidated with reference to the following Examples, which is not intended to limit the invention.

EXAMPLES

In the following experiments, analysis of the products was carried out according to the analytical method for raw sugar described in "Handbook of Sugar Production", edited by the Research Society of Japan Sugar Refineries' Technologists, Asakura Shoten, Jun. 30, 1962. Moisture was measured in a drying method under reduced pressure at 75° C. for 3 hours. Purity was determined according to the aforesaid formula (1) from polarization measured using the Spencer method. A reducing sugar content was measured using a methylene blue method. An ash content was measured using a sulfate ash content method. A color value (AI) was measured in accordance with the aforesaid formula (2) from a Bx (Brix degree) and absorbance (ABS) at 560 nm, with the Bx being measured on a refractometer for Bx measurement. pH was measured on a pH meter.

Hereinafter, percentage is percentage by weight, unless otherwise indicated.

Example 1

(1) Preparation of a composition

Six liters of sugar cane juice having Bx 21.6, purity of 84% and pH 5.5 were filtered through a glass fiber filter, GA100, ex ADVANTEC TOYO KAISHA Ltd., in order to remove foreign substances. Solutions, which contained 504 g, 324 g, 216 g, 92.6 g, and 0 g of granulated sugar in each 1,000 g of the cane juice respectively, were prepared. In these solutions, solid weight ratios of cane juice to sucrose are 3:7, 4:6, 5:5, 7:3 and 10:0 (Reference Example), respectively. These solutions were heated to 125° C. to be concentrated under atmospheric pressure, and cooled to crystallize on a mixer (CS type 25, Kanto Kongo-ki Kogyo, Co., Ltd.), while stirring with a kneading type mixing impeller at 260 rpm. A part of granules obtained was dried on a MIDGET-DRYER, ex Fuji Paudal Co., Ltd., with flowing warm air at 50° C. to obtain granulated noncentrifugal sugar compositions keeping natural flavor originated from cane juice. The results are as indicated in Table 2, Nos. 1 to 5, wherein No.5 is a Reference Example.

TABLE 2

| Sample No. | Solid Weight Ratio, Cane Juice: Granulated Sugar | moisture, % | Purity, % | Reducing Sugars, % | Ash, % | Color Value (AI) |
|---|---|---|---|---|---|---|
| 1 | 3:7 | 0.6 | 93.1 | 3.5 | 1.1 | 640 |
| 2 | 4:6 | 0.8 | 91.7 | 4.2 | 1.4 | 800 |
| 3 | 5:5 | 0.8 | 90.1 | 5.0 | 1.8 | 1070 |
| 4 | 7:3 | 1.1 | 87.0 | 6.5 | 2.5 | 1500 |
| 5 | 10:0 ( Ref. Ex.) | 1.2 | 82.3 | 8.7 | 3.5 | 2000 |

(2) Taste quality test of the compositions

8% aqueous solution of each composition obtained above was prepared. The taste quality thereof was evaluated. The results are shown in Table 3. In this test, brown sugar and granulated sugar were used for control, and the results are also shown in Table 3.

TABLE 3

| | Quality of Taste | |
|---|---|---|
| Sample | Natural flavor originated from sugar cane | Evaluation |
| Granulated sugar | no | sweet taste only, no flavor |
| Brown sugar | no | strong flavor of brown sugar |
| No. 1 | yes (weak) | botanical flavor which is characteristic of sugar cane |
| No. 2 | yes (stronger than No. 1 and weaker than No. 3) | botanical flavor which is characteristic of sugar cane |
| No. 3 | yes (stronger than No. 2 and weaker than No. 4) | botanical flavor which is characteristic of sugar cane |
| No. 4 | yes (stronger than No. 3 and weaker than No. 5) | botanical flavor which is characteristic of sugar cane |
| No. 5* | yes (strong) | botanical flavor which is characteristic of sugar cane |

*Ref. Ex. (cane juice only)

Example 2

Noncentrifugal sugar compositions were prepared as in Example 1, Nos. 2 and 4, except that moisture values were varied at the final drying process. Samples (a) to (e) have the same composition as No.2 in which a solid weight ratio of cane juice to granulated sugar was 4:6 and purity was 91.7%, except for moisture value. Samples (f) to (j) have the same composition as No.4 in which a solid weight ratio of cane juice to granulated sugar was 7:3 and purity was 87.0%, except for moisture value.

These samples were placed in a highly moisture-proof bag and stored at 25° C. and a relative humidity of 50% for four weeks. Evaluations for the change with the passage of time in color value and in flavor are shown in Table 4.

TABLE 4

| Sample Composition | Color Value (AI) | | |
|---|---|---|---|
| moisture, % Used | Immediately after preparation | 4 weeks after preparation | Change of flavor 4 weeks after preparation |
| (a) 3.1 | 800 | 2260 | change into strong flavor like brown sugar |
| (b) 2.5 | 800 | 1530 | change into strong flavor like brown sugar |
| (c) 2.0 | 800 | 960 | some brown sugar-like flavor |
| (d) 1.1 | 800 | 820 | no change in flavor |
| (e) 0.6 | 800 | 820 | no change in flavor |
| (f) 3.3 | 1500 | 4100 | change to strong flavor like brown sugar |
| (g) 2.5 | 1500 | 3240 | change to strong flavor like brown sugar |
| (h) 1.9 | 1500 | 1850 | some brown sugar-like flavor |
| (i) 1.3 | 1500 | 1550 | no change in flavor |
| (j) 0.8 | 1500 | 1530 | no change in flavor |

As seen from Table 4, moisture value is important in a noncentrifugal sugar composition and if it exceeds 2%, the change with the passage of time in color value is large, and flavor deteriorates, too. The composition of which water content is not more than 2% is colored little and keeps natural flavor originated from sugar cane after about ten months storage.

Example 3

After removing large foreign substances from cane juice having Bx 22, purity of 84% and pH 5.5 with a screen filter with a slit size of 0.1 mm, the juice was heated to 70° C. on a juice heater, and then subjected to ultrafiltration with a tubular type ultrafilter membrane (type MH-25, Daicel Chemical Industries Ltd., an effective membrane area of 2 $m^2$×3 tubes and a fractionation molecular weight of 100,000). The filtrate was mixed with granulated sugar to adjust purity to 95% in a blend tank which is indicated by (1) in FIG. 1. Thus, purity was set to be about 1.8% higher than that of the product to be obtained because of decomposition of sucrose during heating and concentrating.

This solution was sent to a thin-film vacuum evaporator (3) with a heating area of 17 $m^2$ by a pump (2) at a rate of 190 liters per hour to exchange heat with steam via a bulkhead plate. And it was concentrated until Bx 92 was attained, and then it was separated from vapor by a vapor separator (4).

The concentrated solution was then sent to a turbulizer (6), ex Hosokawa Micron Corporation, 1900 rpm, by a pump (5) at a rate of 87 liters per hour. The concentrated solution solidified immediately due to a strong shearing force caused by paddles at high speed inside the turbulizer. The granulated noncentrifugal sugar composition with moisture of about 4% was thus prepared in a production efficiency of about 78 kg/hour.

The granulated noncentrifugal sugar composition obtained was dried in a fluidized bed dryer (7), Fuji Paudal Co., Ltd., MDD-3000N, to obtain moisture of the product of 0.8%. The granulated noncentrifugal sugar composition after the drying was sieved on a sifter (8) in order to uniform the particle size, after that it was cooled in a hopper (9) through which dry air was blown to obtain a product (11).

The composition thus obtained had color value of AI650 and purity of 93.0%. It was yellowish white granules with natural flavor originated from a sugar cane.

Example 4

A noncentrifugal sugar composition was prepared using the same apparatus as used in Example 3, but at a changed solid content ratio of cane juice to granulated sugar and a changed production rate so as to obtain a granulated composition. The purity and production rate of the composition finally obtained are shown in Table 5 below.

TABLE 5

| Product | Purity (%) | Production rate kg/hr |
|---|---|---|
| A | 93.0 | 78 |
| B | 90.0 | 60 |
| C | 87.0 | 40 |
| D (Com. Ex.) | 85.0 | impossible to produce |

For Product A, the preparation could be stably carried out at a production rate of 78 kg/hour for about ten hours, whereas for Product B at a production rate of 60 kg/hour for about five hours. For Product C, as adhesion of solid materials to the inside the turbulizer occurred, stable preparation at a production rate of 40 kg/hour could be carried out only for about two hours. From these results, it is seen that a higher purity of a product is better for increasing a production efficiency and a yield. For comparison, Product D having purity of 85.0% was prepared in the same procedure as above. Adhesion of solid materials to the inside the turbulizer occurred so remarkably that the product could be hardly prepared at a production rate of 40 kg/hour.

Example 5

The angle of repose and the angle of exhausting, which are indices of fluidity, were determined on composition No. 4 (prepared in Example 1 and having a weight ratio of a total solid content of cane juice to granulated sugar of 7:3, an average particle size of 660 μm, coefficient of variation of 0.15 and moisture value of 1.1%), white soft sugar, A, ex Mitsui Sugar Co., Ltd. and granulated sugar, GM, ex Mitsui Sugar Co., Ltd. The angle of repose and the angle of exhausting were determined as follows Angle of Repose:

A sample was dropped from a sample hopper to a disc stand for determination having a diameter of 40 mm. The dropping was stopped at the moment when a stack of a sample was highest and then the angle of a slope of the stack was determined.

Angle of Exhausting:

After a measurement vessel (height of 92 mm, width of 55 mm and depth of 25 mm) was filled with a sample, the sample was exhausted from the vessel. The angle of a slope of the sample remained in the measurement vessel was determined.

TABLE 6

| sample | fluidity | |
|---|---|---|
| | angle of repose | angle of exhausting |
| composition No.4 from Example 1 | 34 | 40 |
| white soft sugar | 62 | —* |
| granulated sugar | 35 | 41 |

*It was impossible to determine the angle, i.e. it was impossible to obtain a constant value.

It was found that the present noncentrifugal sugar composition had excellent fluidity, i.e., lower angles of repose and exhausting, compared to white soft sugar. Further, it exhibits nearly the same angles of repose and exhausting as those of granulated sugar which is known to exhibit better fluidity among many kinds of sugars.

Application Example 1: preparation of tablet sweets

Among the noncentrifugal sugar compositions prepared in Example 1, composition No. 2 having a weight ratio of a total solid content of cane juice to granulated sugar of 4:6 was dried in a MIDGET-DRYER, Fuji Poudal Co., Ltd., with flowing warm air at 50° until moisture of 0.6% was attained. It was then sieved with test sieves to obtain a classified product having a particle size of 840–250 $\mu$m.

160 g of the classified product obtained, 1 g of grapefruit powder, ex Nagaoka Perfumery Co., Ltd., 40 g of granulated vitamin C and 2 g of an aliphatic acid ester of sucrose, DK Ester F-20W, ex Dai-ichi Kogyo Seiyaku Co., Ltd. were mixed together. The mixture was made into tablets in a tablet machine, type HU-T, Hata Iron Works Ltd., in conditions of a tablet making pressure of 500 kg and a tablet diameter of 5 mm.

Composition No. 2 used did not adhere to the tablet machine and was excellent in fluidity which is important to a material for tablet sweets. The tablet sweets obtained had a good flavor which is natural and profound.

Application Example 2: preparation of pancakes

An egg, 70 g of noncentrifugal sugar composition No.1 obtained in Example 1, 300 g of milk, and 13 g of salad oil were mixed together, and a mixture of 200 g of flour and 3 g of baking powder were added to them in two or three portions with mixing to prepare batter. An oil-spread frying pan was heated and a proper amount of the aforesaid batter was poured thereto. The batter was baked until both sides of it became brownish to obtain a pancake. As a control, the same amount of white soft sugar was used in place of composition No.1 to prepare batter in the same manner as above.

The batter obtained using composition No.1 had a natural flavor originated from sugar cane, unlike the control batter. The batter obtained using composition No.1 was easy to shape and exhibited good dispersiveness when it was mixed with flour (i.e. few undissolved lumps) and smoothness on the surface of the pancake, as same as in the control batter.

Application Example 3: preparation of mitarashi-dango

In order to prepare sauce for Mitarashi-dango, i.e. dumplings with brown sauce, 25 ml of soy sauce, 50 g of noncentrifugal sugar composition No.4 obtained in Example 1, a spoon of cornstarch and 100 g of water were put in a pan and were concentrated over medium heat while mixed by a wooden ladle until they became thick. The sauce thus obtained was brushed generously on dumplings just after grilled to obtain Mitarashi-dango. As a control, the same amount of white soft sugar was used in place of composition No.4 to prepare sauce. This sauce was used to prepare Mitarashi-dango.

In Mitarashi-dango with composition No.4, acrid taste of soy sauce was suppressed and roasted aroma and deepness was felt, as compared with the control.

Application Example 4: preparation of powdered tuna

Commercially available canned tuna was used after removing its oily portion. 95 g of the oil-removed tuna, a spoon of soy sauce, 9 g of noncentrifugal sugar cane composition No. 4 obtained in Example 1 and a half spoon of Japanese Sake were placed in a pan. While the tuna was being loosened, the pan was heated until water evaporated and the whole content of the pan became dry to prepare powdered tuna. As a control, the same amount of white soft sugar was used in place of composition No.4 to prepare powdered tuna in the same manner as above.

Comparing the two types of powdered tuna, the one obtained using white soft sugar had fish odor, whereas the other obtained using composition No.4 had a preferable flavor with the fish odor being suppressed.

Application Example 5: preparation of coffee bavarois

To 300 g of milk were added 100 g of noncentrifugal sugar composition No.4 obtained in Example 1 and were warmed. 12 g of plate gelatin which had been soaked in water and then squeezed were added to these and the mixture was heated to dissolve the gelatin. Heating was then stopped. Two egg yolks and two spoons of instant coffee powder were added to this, followed by sufficient mixing. The mixture obtained was then cooled rough with cooled water. After 15 ml of rum were added to the mixture, it was cooled until it became thick, that is, to a state in which fluidity was kept, but viscosity increased apparently. 150 ml of flesh cream were added to the mixture, which was then poured into a mold. The mixture was cooled in a refrigerator for two hours to solidify. The mold was warmed in warm water to remove bavarois. The bavarois obtained was decorated with flesh cream. As a control, the same amount of white soft sugar was used in place of composition No.4 to prepare coffee bavarois.

The coffee bavarois with composition No.4 had a simple sweetness and roasted coffee flavor, that is, advanced flavor, compared to the control with white soft sugar.

Application Example 6: preparation of a skin for manju

After 70 g of noncentrifugal sugar composition No.4 obtained in Example 1 were dissolved in warm water and this solution was cooled, 100 g of flour and ⅔ teaspoon of a blowing agent were added to the solution. The mixture obtained was made into a mass, which was then divided into 12 equal parts to prepare a skin for manju, i.e., buns with a bean-jam filling. Next, 150 g of adzuki beans were boiled in water which were then decanted. The adzuki beans thus boiled were boiled again in water until the beans were softened. The boiling water was drained through a sieve. 150 g of noncentrifugal sugar composition No.4 obtained in Example 1 were added to the beans. This was cooked over medium heat with mixing and then spread in a tray and cooled. The beans thus obtained were made into dumplings of a weight of 30 g. The dumplings were cooled in a refrigerator. Jam made of crushed beans was thus prepared. The jam in a form of a dumpling was wrapped with the aforesaid skins. Water was sprayed on the surface and the whole was steamed in a basket steamer over high heat for ten minutes. These were then cooled quickly by fanning them with a fan. Manjus were thus obtained. As a control, skins were prepared using white soft sugar. The aforesaid jam made of crushed beans with noncentrifugal sugar composition No.4 of the present invention was wrapped by these skins to prepare manjus as mentioned above.

In the manju with composition No.4, the skin itself exhibits flavor originated from a noncentrifugal sugar composition and, therefore, had a good taste, compared to the control with white soft sugar.

Application Example 7: preparation of sauce for cooled Chinese noodle

Five spoons of noncentrifugal sugar composition No.4 obtained in Example 1, ⅔ cups of Chinese soup, a half cup of soy sauce, five spoons of vinegar, a small amount of salt, a small amount of pepper and a small amount of soup stock were mixed to each other and the mixture was then cooled in a refrigerator to prepare sauce for cooled Chinese noodle. Topping ingredients were put on noodle, to which the sauce was poured to prepare cooled Chinese noodle. As a control, the same amount of white soft sugar was used in place of composition No.4 to prepare sauce for cooled Chinese noodle. Using this sauce, cooled Chinese noodle was prepared as mentioned above.

In the cooled Chinese noodle with composition No.4, odor of vinegar was not too strong and the taste was simple and cool, compared to the control with white soft sugar.

Example 6

1. Step of preparing sugar syrup

After removing large foreign substances from cane juice, which had been obtained by crushing sugar cane with a crusher and had Bx 21.2, purity of 84.5% and pH 5.5, with a screen filter with a slit size of 0.1 mm, the cane juice was heated to about 70° C. on a plate heater and then filtered through a tubular type ultrafilter membrane (type MH-25, Daicel Chemical Industries Ltd., and an effective membrane area of 2 $m^2$×30 tubes) with a fractionating molecular weight of 100,000. Fine liquor, sucrose solution, having Bx 58.0 and a purity of 99.3% was mixed with this filtered cane juice having Bx 19.8 and a purity of 84.5% to prepare sugar syrup having Bx 28.0 and a purity of 91.2% in a blend tank.

2. Step of heating and evaporating the sugar syrup

This sugar syrup was then heated and evaporated from Bx 28.0 to Bx 40.0 with a first plate-type heat exchanger. Under reduced pressure, the concentrated syrup was separated from steam with a vapor separator. The concentrated syrup thus obtained was fed to a second plate-type heat exchanger and heated and evaporated from Bx 40 to Bx 65. Further, under reduced pressure, the concentrated syrup was separated from steam with a vapor separator. The concentrated syrup thus obtained was heated and evaporated from Bx 65 to Bx 93 with a third plate-type heat exchanger. Under atmospheric pressure, this concentrated syrup having Bx 93 was separated from steam with a vapor separator. The value of Bx was read from a conversion table which shows relation between liquid temperatures and Bx's of sugar liquid under atmospheric pressure. That is, because the outlet temperature of the third plate-type heat exchanger, i.e., inlet temperature of the vapor separator, was about 127° C., the value of Bx 93 was obtained.

3. Step of crystallizing the sugar syrup

The sugar syrup which had been concentrated to Bx 93 was fed to a horizontal continuous crystallizing machine with high speed paddles (turbulizer, ex Hosokawa Micron Corporation, 800 rpm, 30 inchs paddles) and then crystallized. The crystallizing machine was operated in the following conditions; a peripheral speed of the paddles of 32 m/sec., a relative humidity of heated dry air introduced into the crystallizing machine of 4.5% (at a temperature of 85° C.) and an air volume of 12 $Nm^3$/min. per ton of the granule-formed sugar discharged from the crystallizing machine per hour. Under the aforesaid conditions, the concentrated sugar syrup was subjected to a strong shearing force by the paddles of the crystallizing machine to crystallize quickly. The granule-formed sugar was thus prepared at a production capacity of about 1.1 tons/hour. Then, the granule-formed sugar from the crystallizing machine had a temperature of about 110 to 120° C. and a purity of 90.6% and a moisture of 2.0%.

4. Step of drying, cooling and conditioning the sugar

The granule-formed sugar obtained in step 3 was introduced into a hopper in which dry air (temperature of about 45° C. and relative humidity of 25%) was blown in a volume of 15 $m^3$/min. per 30 tons of the granule-formed sugar, via a screw conveyor having a structure of efficiently removing vapor generated from the granule-formed sugar by air ventilation, that is, by blowing and sucking air. When the granule-formed sugar entered the hopper from the screw conveyor, it had a temperature of about 100° C. and a moisture of 1.5%. The step of drying, cooling and conditioning the sugar in the hopper was carried out for 24 hours until the moisture of the granule-formed sugar reached equilibrium moisture. The moisture of the granule-formed sugar after the conditioning was 0.8%. Subsequently, in order to uniform the particle size, the granule-formed sugar was screened on a sifter having 16 mesh-screen. The part passed through the screen was granule-formed sugar product (A).

5. Properties of the product

The granule-formed sugar thus obtained had a purity of 90.6%, a moisture of 0.8% and a color value (AI) of 1030. It was yellowish white granule-formed sugar with natural flavor originated from sugar cane. This granule-formed sugar had excellent properties such as excellent fluidity and less solidified.

Comparison Example 1

The sugar syrup was prepared as in step 1 in Example 6, except that the purity of the sugar syrup was adjusted to 85.8%. Next, the same procedures as in steps 2 and 3 in Example 6 were repeated. However, in step 3, completely crystallized one as well as incompletely crystallized one came out of the turbulizer together. In addition, remarkable adherence of solidified materials to the inside of the turbulizer occurred and, therefore, the production efficiency decreased gradually. The incompletely crystallized part was fed together to the next step 4 in Example 6, that is, fed to a hopper via the screw conveyor, solidification occurred easily and, in addition, a longer processing time was needed for the step of drying, cooling and conditioning sugar, compared to that in Example 6. Further, no satisfactory product was obtained. It has been found that when a purity is so low, continuous industrial production is difficult to carry out.

Comparison Example 2

The sugar syrup was prepared as in step 1 in Example 6, except that the purity of the sugar syrup was adjusted to 95.7%. Next, the same procedures as in steps 2 and 3 in Example 6 were repeated. The granule-formed crystallized sugar was fed to step 4 in Example 6. When it was fed via the screw conveyor to a hopper, solidification occurred easily in the hopper and, therefore, the step of drying, cooling and conditioning the sugar could not be stably carried out. The granule-formed sugar on the screw conveyor immediately before entering the hopper had a temperature of about 100° C. and a moisture of 1.5% by weight. It has been found that when the purity is so high, granule-formed sugar solidify easily in a hopper in the step of drying, cooling and conditioning sugar. In addition, this granule-formed sugar was easily solidified during the storage.

Comparison Example 3

The same procedures as in steps 1 to 3 in Example 6 were repeated. Next, the prior art step of drying, cooling and conditioning sugar (i.e., drying with a dryer, cooling with a cooler and conditioning with a hopper) was carried out, in place of step 4 of Example 6 (drying, cooling and conditioning all with a hopper). More specifically, the granule-formed sugar obtained in step 3 (temperature of 40 to 45° C. and moisture of 0.9% by weight) was dried to a moisture of 0.7% by weight in a fluidized bed dryer, MDD-3000N, ex Fuji Paudal Co., Ltd., in which warm air of about 60 to 70° C. was blown, and then cooled in a cooler until the temperature of the granule-formed sugar became about 30 to 35° C. Subsequently, it was conditioned in a hopper for 24 hours until the moisture of the granule-formed sugar reached equilibrium moisture. After the conditioning, in order to uniform the particle size, the granule-formed sugar was screened on a sifter to obtain granule-formed sugar product (B).

The granule-formed sugar had a purity of 90.5%, a moisture of 0.7% and a color value (AI) of 1120. It was yellowish white granule-formed sugar with natural flavor originated from sugar cane.

Testing Example

A loading test was carried out on granule-formed sugar product (A) obtained in Example 6 and granule-formed sugar product (B) obtained in Comparison Example 3. As a result, there were seen the differences indicated in Table 7.

The loading test was carried out as follows. Each of Product A and product B was packed in each two small sugar bags (OP20 μm/PE60 μm). A load of 120 kg was put on the whole area of these four bags. This load corresponds to a weight of 12 stacks of large sugar bags of 20 kg. These four bags were taken out and observed one month and 2 months after the test was started.

TABLE 7

| | Granule product (A) in Example 6 | Granule product (B) in Comp. Ex.3 |
|---|---|---|
| Moisture immediately after the preparation, % | 0.8 | 0.7 |
| One month later | | |
| Moisture, % | 0.8 | 0.8 |
| Condition | Slightly compacted by pressure, but easily loosened so as not to be taken up as a block. | Slightly compacted by pressure, but easily loosened so as not to be taken up as a block. |
| Two months later | | |
| Moisture, % | 0.8 | 0.8 |
| Condition | Similar as one month before. | Compacted so tightly as to be broken by pressing with fingers. |

As seen from the above result, the granule-formed sugar product which is produced via the step of drying, cooling and conditioning sugar according to the present process (i.e., one step with a hopper) is different in physical properties with simplified procedures and decreased costs of equipments, compared to the product treated according to the prior art process (i.e., three steps of drying, cooling and conditioning). Although the granule-formed sugar product obtained by the present process and the granule-formed sugar product obtained by the prior art process had approximately the same moisture value, the granule-formed sugar product obtained by the prior art process started to solidify slightly two months after the loading test started, while the product obtained by the present process did not solidify.

In the present process, the granule-formed sugar was slowly dried with dry air. The granule-formed sugar is generally composed of crystals each of which is covered with syrup film or molasses part. Microscopically, this slow drying according to the invention enhances crystallization of sucrose contained in syrup film sufficiently to shift the granule in a stable state. Meanwhile, macroscopically, the granule-formed sugar is in a homogeneous stable state as a whole where non-crystalline parts, i.e., molasses part, is not localized and minimized in volume. In the granule-formed sugar in this homogeneous state as a whole, it is difficult for moisture to migrate in the granule-formed sugar, so that the granules are hard to solidify. Meanwhile, in the prior art process, it is impossible to enhance crystallization of sucrose covered with syrup film present in the inside of granules because the syrup films present on the surface of the granules are quickly dried by a dryer. Accordingly, such a granule has more non-crystalline parts and is not in a stable state. As the results, it is considered that moisture in the non-crystalline parts enhances recrystallization of sucrose during storage and, therefore, causes neighboring granules to solidify with each other.

When the step of drying, cooling and conditioning sugar is carried out in one step with a hopper, it is expected that because non-crystalline parts are present very stably in the granule-formed sugar after dried, the granule-formed sugar is hard to solidify, compared to the product treated in the prior art step of drying, cooling and conditioning sugar.

Reference Example 1

In this Example, there were studied relation between relative humidity of dry air in a hopper and moisture of a granule-formed sugar product in step 4 of the present process, and relation between moisture of a granule-formed sugar product and its solidifying property. From the results, optimum moisture of the granule-formed sugar product was obtained. Further, examined was the optimum moisture of granule-formed sugar just before entering the hopper to give the optimum moisture of the granule-formed sugar product.

(1) Examination of relative humidity

The same procedures as in steps 1 to 3 in Example 6 were repeated. The granule-formed sugar crystallized in step 3 was introduced to a hopper via a screw conveyor. The granule-formed sugar on the screw conveyor before entering the hopper had a temperature of about 100° C. and a moisture of 1.6% by weight. In the hopper, air having a relative humidity of 25, 30, 35, 40, 45, 50 or 60% was fed through the bottom of it. The step of drying, cooling and conditioning sugar was carried out for 24 hours until the moisture of the granule-formed sugar reached equilibrium moisture. The relation between relative humidity of the dry air and moisture of granule-formed sugar after the step of drying, cooling and conditioning sugar is as shown in Table 8.

TABLE 8

| | Relative Humidity, % | Moisture of granule-formed sugar after the step of drying, cooling and conditioning, % by weight |
|---|---|---|
| (a) | 25 | 0.8 |
| (b) | 30 | 1.0 |
| (c) | 35 | 1.3 |
| (d) | 40 | 1.4 |
| (e) | 45 | 1.5 |
| (f) | 50 | 1.7 (hygroscopic) |
| (g) | 60 | 2.0 (hygroscopic) |

(2) Loading test

Each of products (a) to (g) obtained in (1) was subjected to the loading test. The results are as shown in Table 9.

The loading test was carried out as mentioned above.

TABLE 9

| Product | Condition One Month Later | Condition Two Months Later |
|---|---|---|
| (a) | No solidification observed | No solidification observed |
| (b) | No solidification observed | No solidification observed |
| (c) | No solidification observed | No solidification observed |
| (d) | No solidification observed | Slight solidification observed |
| (e) | Slight solidification observed | Slight solidification observed |
| (f) | Slight solidification observed | Slight solidification observed |
| (g) | Solidification observed | Solidification observed |

As seen from the above results, it has been found that it is preferred to dry the granule-formed sugar product in a hopper to a moisture value of at most 1.3% by weight, considering solidification during the storage of the product.

(3) Examination of the moisture of the granule-formed sugar product before entering a hopper The same procedures as in steps 1 and 2 in Example 6 were repeated. In step 3, granule-formed sugar was crystallized with a horizontal continuous crystallizing machine with high speed paddles in the same conditions as in Example 6. The granule-formed sugar was fed via a screw conveyor to a hopper from which vapor was being sucked. The moisture value of the granule-formed sugar just before entering the hopper was adjusted to 2.5, 2.0, 1.6, 1.3 or 1.0%. The states of these granule-formed sugar were observed. The results are as shown in Table 10. The conditions of the dry air fed through the bottom of the hopper were same as in Example 6.

TABLE 10

| Moisture, % | Condition in the Hopper |
|---|---|
| 2.5 | Solidification observed |
| 2.0 | Slight solidification observed (hardening on the surface) |
| 1.6 | No solidification observed |
| 1.3 | No solidification observed |
| 1.0 | No solidification observed |

From the results, it has been found that a moisture of at most 2.0% by weight, more preferably at most 1.6% by weight, is preferred for granule-formed sugar immediately before entering a hopper in the step of drying, cooling and conditioning the sugar according to the invention.

Reference Example 2

In this Example, optimum conditions for ultrafiltration carried out in Example 6 were examined.

As in step 1 in Example 6, cane juice was filtered through a tubular type ultrafilter membrane (type MH-25, Daicel Chemical Industries Ltd., and an effective membrane area of 2 $m^2$×3 tubes) with a fractionating molecular weight of 10,000, 30,000, 40,000, 100,000, 150,000 or 500,000. Fine liquor was mixed with this filtered cane juice in a blend tank to prepare sugar syrup so that the purity of the sugar syrup was 91.0%. In step 2, the sugar syrups were concentrated to Bx 93 using a plate-type heat exchanger, and then the concentrated syrup were separated from steam with a vapor separator. Subsequently, in step 3, crystallization was carried out with a horizontal continuous crystallizing machine with high speed paddles (turbulizer, ex Hosokawa Micron Corporation, 2800 rpm, 8-inch paddle) with a speed of paddles of 29.8 m/sec. Next, in step 4, the step of drying, cooling and conditioning the sugar was carried out in a hopper. The conditions in steps 3 and 4 were same as in Example 6.

TABLE 11

| Fractionating Molecular Weight | Permeation rate, kg × solid content/hour × $m^2$ | Condition immediately after leaving a horizontal continuous crystallizing machine with high speed paddles | Drying in a hopper |
|---|---|---|---|
| 10,000 | 3.0 | Whole crystallization (granule state) | Possible (not solidified) |
| 30,000 | 4.5 | Whole crystallization (granule state) | Possible (not solidified) |
| 40,000 | 5.4 | Whole crystallization (granule state) | Possible (not solidified) |
| 100,000 | 8.3 | Whole crystallization (granule state) | Possible (not solidified) |
| 150,000 | 12.5 | Whole crystallization (granule state) | Possible (not solidified) |
| 500,000 | 14.6 | Partly impossible to crystallize | Impossible (easily solidified) |

In has been found that when use is made of the cane juices which are filtered through the tubular type ultrafilter membranes with a fractionating molecular weight of at most 150,000 and crystallization is carried out with a horizontal continuous crystallizing machine with high speed paddles, the whole amount could be crystallized. Further, the drying in a hopper could be carried out without any troubles. However, the production speed decreases when the fractionating molecular weight of the tubular type ultrafilter membrane was less than 30,000 because a filtration rate of cane juice decreases.

In the case where use was made of the cane juice which was filtered through the tubular type ultrafilter membrane with a fractionating molecular weight of more than 150,000 and crystallization was carried out with a horizontal continuous crystallizing machine with high speed paddles, complete crystallization could not be carried out sometimes. This is probably due to the fact that in the case of filtration through a tubular type ultrafilter membrane with a fractionating molecular weight of more than 150,000, the sugar syrup still contains high molecular weight impurities or suspended materials originated from cane juice which prevent the sugar syrup from crystallizing.

Reference Example 3

In this Example, the optimum speed of paddles was examined for a horizontal continuous crystallizing machine with high speed paddles.

All of the steps in Example 6 were repeated except that the speed of paddles of the crystallizing machine in step 3 in Example 6 was 15, 20, 25, 30, 35, 40, 45 or 50 m/sec. The state of the granule-formed sugar just after coming out of the crystallizing machine and the drying state of it in a hopper were observed.

TABLE 12

| Peripheral speed of the crystallizing machine, m/sec. | Condition immediately after leaving a horizontal continuous crystallizing machine with high speed paddles | Drying in a hopper |
|---|---|---|
| 15 | Tendency not to crystallize partly and become creamy. | Impossible to dry |
| 20 | Whole crystallization | possible to dry (partly solidified) |

TABLE 12-continued

| Peripheral speed of the crystallizing machine, m/sec. | Condition immediately after leaving a horizontal continuous crystallizing machine with high speed paddles | Drying in a hopper |
|---|---|---|
| 25 | Whole crystallization | possible to dry (not solidified) |
| 30 | Whole crystallization (with regulated size distribution) | possible to dry (not solidified) |
| 35 | Whole crystallization (with regulated size distribution) | possible to dry (not solidified) |
| 40 | Whole crystallization (with regulated size distribution) | possible to dry (not solidified) |
| 45 | Whole crystallization | possible to dry (not solidified) |
| 50 | Crystallized with a lot of powdery ones | possible to dry (not solidified) |

From the results in Table 12, it is seen that in the step of crystallizing sugar syrup, a speed of paddles of the crystallizing machine of 25 to 45 m/sec. is preferred. If the speed of paddles was too low, i.e., 20 m/sec., the shearing force is weak and, therefore, it is impossible to attain complete crystallization. Meanwhile, if the speed of paddles is too high, e.g., 50 m/sec., crystallized sugar is of a fine powder shape rather than granules. This fine powdery sugar causes dust easily when dry air is fed in a hopper in the next step of drying, cooling and conditioning sugar and is hard to handle.

When a speed of paddles was 30 to 40 m/sec., the particle size distribution tends to be in a narrow range. Accordingly, this range of the speed is preferred for the step of drying, cooling and conditioning sugar. In addition, it is preferred because of good fluidity and less solidification.

We claim:

1. A process for the preparation of a noncentrifugal sugar composition, characterized in that the process comprises the following steps: cane juice is filtered; a pH of the juice is adjusted to 5.0–6.0; sucrose or liquid sucrose or both is added to adjust a purity of the mixture to a range of 87.0 to 95.1% by weight; the mixture is heated and evaporated; and then the mixture is cooled to solidify with a strong shearing force being applied to obtain granules.

2. A process for the preparation of granule-formed sugar which comprises a step of preparing sugar syrup, a step of heating and evaporating the sugar syrup, a step of crystallizing the sugar syrup to obtain sugar and a step of drying, cooling and conditioning the sugar, characterized in that a purity of the sugar syrup obtained from the step of preparing sugar syrup is adjusted to a range of 87.0 to 95.1% by weight before the step of heating and evaporating the sugar syrup, the crystallization of the sugar syrup is carried out with a strong shearing force being applied to obtain granule-formed sugar, and the step of drying, cooling and conditioning the sugar is carried out in a way where the granule-formed sugar obtained from the step of crystallization is fed and dried in a hopper through the bottom of which dry air is blown in.

3. The process for the preparation of the granule-formed sugar claimed in claim 2, wherein the sugar syrup before the step of heating and evaporation is one which is obtained by filtering cane juice through an ultrafilter membrane with a fractionating molecular weight of 30,000 to 150,000, and by adding sucrose or liquid sucrose or both to adjust the purity to a range of 87.0 to 95.1% by weight.

4. The process for the preparation of the granule-formed sugar claimed in claim 2, wherein the application of a strong shearing force in the step of crystallization is carried out using a horizontal continuous crystallizing machine with high speed paddles.

5. The process for the preparation of the granule-formed sugar claimed in claim 2, wherein the sugar syrup from the step of heating and evaporation has a Brix degree of Bx 90.5 to Bx 95.3.

6. The process for the preparation of the granule-formed sugar as claimed in claim 2, wherein the application of a strong shearing force in the step of crystallization is carried out using a horizontal continuous crystallizing machine with high speed paddles at a peripheral speed of 25 to 45 m/sec.

7. The process for the preparation of the granule-formed sugar as claimed in claim 2, wherein the application of a strong shearing force in the step of crystallization is carried out using a horizontal continuous crystallizing machine with high speed paddles and said horizontal continuous crystallizing machine with high speed paddles is fed with heated dry air of a relative humidity of RH 10% or less in an air volume of 9 to 30 $Nm^3$/min. per ton of the granule-formed sugar discharged per hour.

8. The process for the preparation of the granule-formed sugar as claimed in claim 2, wherein a conveyer is used to transfer the granule-formed sugar from the step of crystallization to the step of drying, cooling and conditioning the sugar, and said conveyer is provided with a mean of effectively removing vapor generated from the granule-formed sugar by blowing and sucking air during the transfer, whereby a moisture value of the granule-formed sugar just before entering the hopper is adjusted to at most 2.0% by weight.

9. The process for the preparation of the granule-formed sugar claimed in claim 2, wherein the dry air has a temperature of 40 to 50° C. and a relative humidity of RH 35% or less in the step of drying, cooling and conditioning the sugar.

10. The process for the preparation of the granule-formed sugar claimed in claim 2, wherein the granule-formed sugar is dried to a moisture value of 0.4 to 1.3% by weight in the step of drying, cooling and conditioning the sugar.

11. The process for the preparation of the granule-formed sugar claimed in claim 2, wherein the granule-formed sugar is dried to a moisture value of 0.4 to 0.9% by weight in the step of drying, cooling and conditioning the sugar.

12. A noncentrifugal sugar composition comprising cane juice and sucrose and/or liquid sucrose, characterized in that the composition has a color value of not more than AI2000, a purity of 86.0 to 93.1% by weight and a moisture of not more than 2.0% by weight.

13. The composition claimed in claim 12, wherein the purity is 89.0–93.1% by weight.

14. The composition claimed in claim 12, wherein the color value is not more than AI1500.

15. The composition claimed in claim 12, wherein the moisture is not more than 1.3% by weight.

16. The composition claimed in claim 12, wherein the moisture is 0.4–1.3% by weight.

17. The composition claimed in claim 12, wherein a proportion of a solid weight of the cane juice to the weight of the noncentrifugal sugar composition is 30–70% by weight.

* * * * *